US009210522B2

(12) United States Patent
Obradovic et al.

(10) Patent No.: US 9,210,522 B2
(45) Date of Patent: Dec. 8, 2015

(54) HEARING AID

(75) Inventors: Gojko Obradovic, Copenhagen S. (DK); Henrik Nielsen, Roskilde (DK); Poul Rosenkilde Kristensen, Roskilde (DK)

(73) Assignee: GN RESOUND A/S, Ballerup (DK)

( * ) Notice: Subject to any disclaimer, the term of this patent is extended or adjusted under 35 U.S.C. 154(b) by 139 days.

(21) Appl. No.: 13/084,506

(22) Filed: Apr. 11, 2011

(65) Prior Publication Data

US 2011/0255723 A1 Oct. 20, 2011

(30) Foreign Application Priority Data

Apr. 14, 2010 (EP) ..... 10159929

(51) Int. Cl.
*H04R 25/00* (2006.01)

(52) U.S. Cl.
CPC ..... *H04R 25/658* (2013.01); *H04R 25/652* (2013.01); *H04R 25/656* (2013.01); *H04R 25/48* (2013.01); *H04R 2225/021* (2013.01); *H04R 2225/023* (2013.01)

(58) Field of Classification Search
CPC .... H04R 25/658; H04R 25/65; H04R 25/608; H04R 25/652; H04R 25/02; H04R 1/22; H04R 1/1016; H04R 25/48; H04R 2225/021; H04R 2225/023
USPC ..... 381/54–67, 70–89, 312–331, 337–433, 381/23.1
See application file for complete search history.

(56) References Cited

U.S. PATENT DOCUMENTS 5,002,151 A * 3/1991 Oliveira et al. ..... 181/130
5,068,901 A 11/1991 Carlson
5,701,348 A 12/1997 Shennib et al.
5,832,094 A * 11/1998 Le Her ..... 381/328
5,987,146 A 11/1999 Pluvinage et al.

(Continued)

FOREIGN PATENT DOCUMENTS

EP 0 455 203 A2 11/1991
JP S32-006940 7/1957

(Continued)

OTHER PUBLICATIONS

International Preliminary Report on Patentability dated Jul. 25, 2012 for PCT Patent Application No. PCT/DK2011/000029, 12 pages.

(Continued)

*Primary Examiner* — Davetta W Goins
*Assistant Examiner* — Oyesola C Ojo
(74) *Attorney, Agent, or Firm* — Vista IP Law Group, LLP

(57) ABSTRACT

A hearing aid includes a receiver with a receiver housing, the receiver having a sound port opening, and being configured to be placed at least partly in an ear canal of a user, and a sound tube acoustically connected to the sound port opening of the receiver, the sound tube having a longitudinal extension in at least two directions, wherein the sound tube has a total length of at least 16 mm. A hearing aid includes a behind the ear (BTE) unit configured to process sound and generate an electrical signal, an earpiece, and a signal conductor configured to communicate the electrical signal to the earpiece, wherein the earpiece comprises a receiver that is configured to convert the electrical signal into a sound signal, and wherein the earpiece further comprises a sound tube that is coupled to a sound port opening at the receiver, the sound tube having a longitudinal extension in at least two directions.

35 Claims, 14 Drawing Sheets

(56) References Cited

U.S. PATENT DOCUMENTS

| | | | | |
|---|---|---|---|---|
| 6,078,676 | A * | 6/2000 | Takenaka | 381/338 |
| 6,205,227 | B1 * | 3/2001 | Mahoney et al. | 381/328 |
| 6,724,902 | B1 * | 4/2004 | Shennib et al. | 381/328 |
| 7,587,052 | B2 * | 9/2009 | Kasztelan | 381/60 |
| 7,748,495 | B2 * | 7/2010 | Krueger | 181/199 |
| 8,019,107 | B2 * | 9/2011 | Ngia et al. | 381/338 |
| 8,401,215 | B2 * | 3/2013 | Warren et al. | 381/328 |
| 2003/0081794 | A1 * | 5/2003 | Fushimi et al. | 381/74 |
| 2006/0045297 | A1 | 3/2006 | Haussmann | |
| 2006/0109999 | A1 | 5/2006 | Van Halteren | |
| 2006/0159298 | A1 | 7/2006 | von Dombrowski et al. | |
| 2007/0009130 | A1 * | 1/2007 | Feeley et al. | 381/330 |
| 2007/0182067 | A1 * | 8/2007 | Fickweiler et al. | 264/401 |
| 2009/0087006 | A1 * | 4/2009 | Leong | 381/324 |
| 2011/0051977 | A1 * | 3/2011 | Losko et al. | 381/380 |
| 2011/0261985 | A1 * | 10/2011 | Rung et al. | 381/323 |

FOREIGN PATENT DOCUMENTS

| | | | |
|---|---|---|---|
| JP | S58-43700 | A | 3/1983 |
| JP | H01-15500 | U | 1/1989 |
| WO | 98/44763 | A1 | 10/1998 |
| WO | 2004010734 | A1 | 1/2004 |
| WO | 2010/066299 | A1 | 6/2010 |

OTHER PUBLICATIONS

Written Opinion of the International Searching Authority dated Jul. 25, 2012 for PCT Patent Application No. PCT/DK2011/000029, 8 pages.

International Search Report dated Aug. 26, 2011 for PCT Patent Application No. PCT/DK2011/000029, 4 pages.

First Office Action dated Jan. 14, 2014 for related Japanese patent application No. 2013-504122, 4 pages.

Notification of the First Office Action dated Jul. 15, 2015, for corresponding Chinese Patent Application No. 2011800291919, 21 pages.

* cited by examiner

HEARING AID

RELATED APPLICATION DATA

This application claims priority to and the benefit of European Patent Application No. EP 10159929.8, filed on Apr. 14, 2010, the entire disclosure of which is expressly incorporated by reference herein.

FIELD

The present application pertains to a hearing aid. Especially, the present application pertains to a hearing aid of the type, wherein the receiver is to be placed in the ear of a user during use.

BACKGROUND AND SUMMARY

It is known that traditional hearing aids of the behind the ear type (BTE's), wherein the audio signal from a microphone is processed into a hearing impairment compensated signal and converted into a sound signal by a receiver that is placed in a behind the ear housing and then communicated to an earpiece via a sound tube, offer higher maximum sound pressure levels (SPL) than known hearing aids of the In the ear (ITE), completely in the ear canal (CIC), or receiver in the ear (RIE) types of hearing aids.

This generates a problem for people with moderate to severe hearing loss. ITE, CIC and RIE hearing aids are less conspicuous than traditional BTE hearing aids. This is due to the fact that ITE and CIC hearing aids do not have a BTE unit, and that RIE's have a much smaller BTE unit than traditional BTE hearing aids, because in a RIE hearing aid the receiver, which is a large component, is placed in an earpiece that is adapted to be placed in the ear of a user during use. Thus CIC, ITE and RIE hearing aids are all more attractive to a user than the traditional BTE hearing aids due to the fact that they are less conspicuous. This poses a risk that persons who acquire these less conspicuous CIC, ITE or RIE hearing aids will turn out to be disappointed by the performance of these hearing aids as compared to the traditional BTE hearing aids.

It is thus an object to provide a hearing aid by which it is possible to give the hearing aid user the benefits of a less conspicuous hearing aid and high hearing loss compensatory performance simultaneously.

According to some embodiments, the above-mentioned and other objects are fulfilled by a first aspect that pertains to a hearing aid with a receiver placed in a receiver housing, wherein said receiver is being configured to be placed at least partly in the ear canal of a user, and wherein the hearing aid further comprises a sound tube that is acoustically connected to a sound port opening of the receiver or receiver housing, and wherein the sound tube has a longitudinal extension in at least two directions, ant wherein the sound tube furthermore has a total length of at least 16 mm.

Hereby is achieved a hearing aid that is less conspicuous than traditional BTE hearing aids, because the receiver, which is a relatively large hearing aid component, is configured to be placed at least partly within the ear canal of a user during use. Furthermore, by connecting a sound tube to the receiver output port in order to convey the generated sound into the ear canal of the user during use, the acoustic resonance effect generated by the sound tube will increase the maximum acoustical output of the hearing aid which has the consequence that a hearing aid according to some embodiments with a sound tube construction as described above will be able to generate a higher sound pressure level within the ear cannel of a user during use than is achievable by a hearing aid of conventional design. This increased acoustical output has also the additional benefit that a hearing aid according to some embodiments will have an increased dynamic range as compared with conventional hearing aids known in the art. However, in order to achieve a sufficient resonance effect a sound tube of a sufficient length is needed, and simulations as well as measurements have shown that a sound tube of at least 16 mm is needed. Since the sound tube is connected to a receiver that is to be placed at least partly in the ear canal of a user it is not possible to use a straight sound tube that has a sufficient length to generate the resonance effect that is needed, because the ear canal of an average human is too short. Thus, by having a sound tube that has a longitudinal extension in at least two different directions a longer sound tube can be used, while at the same time being applicable in the limited space available in the ear or ear canal of a user, and at the same time generating a sufficiently high resonance effect that makes a higher amplification possible or enables the hearing aid according to provide a higher output sound pressure level.

According to some embodiments, the sound tube may at least in part abut to the receiver housing (i.e. the surface of the housing) along at least one of the two directions of the sound tube. Hereby is achieved a more compact and thereby smaller earpiece, which also makes it possible to account for a tradeoff between required length of the sound tube and available space in order to achieve the amplification that is needed in order to account for a hearing loss of a user.

Computer simulations have shown that sound tubes having a longitudinal extension that is shorter than the longitudinal extension of present day hearing aid receivers are not effective enough, i.e. the resonance effect is not large enough to provide adequate amplification. Thus, the longitudinal length of the sound tube is preferably larger than the longitudinal extension of the receiver.

According to some embodiments, the receiver housing is configured to be placed completely in the ear canal of a user during use. Hereby is achieved a less conspicuous hearing aid, because the relatively large receiver component is placed completely in the ear canal during use.

However, in an alternative embodiment the receiver housing may be configured to be placed at least in part in the concha or cimba concha, just below the triangular fossa of an ear of a user.

According to another embodiment the longitudinal length of the sound tube along one of the at least two directions may be larger than the longitudinal length of the receiver.

Normally a hearing aid receiver will generate a resonance around 3 kHz that is determined by the mechanical properties of the receiver. These are the stiffness of the receiver suspension system and the air volume behind the membrane, together with the mass of the moving system of the receiver and air in front of it. By connecting a sound tube to the receiver port opening the waveguide effect of the sound tube will create an additional resonance. For the tube length range of 20 mm to 24 mm the resonance will occur between around 3.5 kHz and 4.4 kHz.

It may be shown that in the simplest possible system, i.e. a system wherein a straight sound tube is connected to hard piston in one end and the other end being open will exhibit a resonance exactly at $$F_{res} = \frac{c}{4 - L},$$

where c is the speed of sound that normally can be set to be 343 m/s (for dry air at 20 degrees Celsius), and L is the length of the sound tube.

Now in a real hearing aid, the system is much more complicated than the one described above. For example the piston is the membrane inside a receiver and it drives the front volume of air inside the receiver housing, the sound port and the sound tube. Finally, the end is defined by the ear canal and tympanic membrane and not merely by the open end of the sound tube. However, computer simulations and measurements (see for example FIG. 9, FIG. 10 and the associated description) have shown that the above formula for calculating the resonance frequency is a good approximation for a real system. Thus, for the real system it can be expected that the resonance frequency will be in the neighborhood of the one calculated according to the above formula. Hence, it may be deduced from the above mentioned formula that if the hearing aid according to some embodiments comprises a sound tube that has a length between 18 mm. and 26 mm. optimal resonance properties is achieved both regarding placement and size of the second resonance peak. In further preferred embodiments, the sound tube has a length between 20 mm. and 24 mm, and in a yet more preferable embodiment the sound tube has a length between 18 mm. and 24 mm.

According to some embodiments, the sound tube may have at least two different cross sectional areas. Hereby is achieved a way in which in which the resonance properties of the sound tube may be influenced. For example a resonance chamber may be formed by having an area of increased cross section along the length of the sound tube, preceded and followed by an area of lower cross section.

It has been found practical if according to some embodiments, the two different cross sectional areas both are larger than the area of the receiver port opening.

According to preferred embodiments, the hearing aid may comprise a sound tube with a substantially rectangular cross section. Hereby is achieved that a more compact earpiece may be produced.

In a particularly advantageous embodiment of a hearing aid, the sound tube may be formed as an integral part of an earpiece having a detachable electrical socket system. Hereby is achieved a self-contained unit wherein a receiver may be placed. This self-contained unit may be placed formed in a way so as to fit to a particular standard receiver that is used in RIE hearing aids today.

In some embodiments, the sound tube may be formed as a predefined part to be mounted on or at a receiver. Hereby is obtained a sound tube that is easy to use in conjunction with a receiver. Preferably, the sound tube is formed as an integral part of the earpiece, which thereby can provide mechanical support for the sound tube.

Alternatively, the sound tube may at least in part be formed as an integral part of the receiver housing. Hereby is achieved that a more compact and space saving unit.

According to preferred embodiments, the sound tube is manufactured by a Rapid Prototyping Technology, such as selective laser sintering (SLS) or stereolithography (SLA). Preferably the sound tube is formed as an integral part of an earpiece for a RIE hearing aid using SLA or SLS technology. Alternatively, the sound tube may be formed as an integral part of (for example a tip portion) a ITE or CIC hearing aid shell structure.

According to preferred embodiments, the hearing aid may comprise a sound tube that may be individually formed to have an end user related shape, cross section(s) and length in dependence of the acoustical performance required. This required acoustical performance may in an embodiment for example be a specific desired frequency specific amplification, and/or damping characteristic for feedback suppression. Thus, making it possible to design a sound tube that in conjunction with a specific receiver or receiver type, makes it possible to account for user specific needs, such as audiometric hearing loss. This could for example be done with the help of a dedicated software program that may run on a computer, for example a standard personal computer. The software program could be an extension of the regular software programs provided to hearing aid dispensers. When operating the software program, the dispenser can provide the audiogram and a 3 dimensional scan of the ear and/or ear canal of a potential hearing aid user as inputs to the program. Based on this input the software program then suggests which receiver should be used. This suggestion could be based on the available space estimated from the 3 dimensional scan and/or merely on the basis of the obtained or measured audiogram. The program then calculates the length, shape and form of the sound tube. In addition to this the effects of a possible vent in the earpiece can be accounted for. Finally, the earpiece with sound tube (and possible a vent), and room for the suggested receiver is designed as a 3 dimensional model by the software program and may then be printed by a rapid prototyping technology such as SLS (selective laser sintering) or SLA (stereolithography). Instead of letting the software program suggest a receiver, the receiver type available could be provided as input to the software program.

In other embodiments, the hearing aid may comprise a microphone that, during use, is configured to pick up sound from within the ear canal of a user. Preferably, the microphone is placed in an earpiece that is adapted to be placed in the ear of a user during use, for example it may be placed adjacent to the receiver or be built into the same housing structure as the receiver. In one embodiment sound is transmitted from within the ear canal to the microphone via a second sound tube that during use has an open end that substantially faces the tympanic membrane of a user, and another end that is connected to the microphone. Hereby is achieved a hearing aid wherein the so called occlusion effect may be measured and, hence accounted for.

The microphone may also be configured to pick up sound from outside the ear canal, or alternatively, the earpiece may comprise a further second microphone that is configured to pick up the ambient sound surrounding a user. Hereby is achieved that the natural frequency shaping of the ambient sound field that is done by the outer ear or pinna may be utilized directly. Furthermore, for those embodiments that also comprise a BTE unit, this makes it possible to manufacture an even smaller BTE unit because two relatively large components, the receiver and the microphone(s) are all placed in the earpiece.

In order to preclude clogging of the sound tube by cerumen, the sound tube or earpiece may be equipped with a cerumen filter.

According to an alternative embodiment the hearing aid may comprise a sound tube with a cross sectional area that increases gradually or stepwise or partly gradually and partially stepwise along at least a part of the longitudinal extension of the sound tube from the receiver port opening.

A second aspect pertains to a hearing aid with a receiver that is adapted to be placed at least partly in the ear canal of a user, the receiver comprising a motor and a receiver housing, characterized in that the receiver housing has a integrally formed sound tube which has a longitudinal extension in at least two directions and wherein the sound tube has a total length of at least 16 mm.

A third aspect pertains to a hearing aid which comprises a behind the ear (BTE) unit configured to convert and process sound into an electrical signal and a signal conductor configured to communicate said electrical signal to an earpiece, wherein said earpiece comprises a receiver that is configured to convert said electrical signal into a sound signal, characterized in that the earpiece comprises a sound tube that is connected to the sound port opening of the receiver and having a longitudinal extension in at least two directions.

In accordance with some embodiments, a hearing aid includes a receiver with a receiver housing, the receiver having a sound port opening, and being configured to be placed at least partly in an ear canal of a user, and a sound tube acoustically connected to the sound port opening of the receiver, the sound tube having a longitudinal extension in at least two directions, wherein the sound tube has a total length of at least 16 mm.

In accordance with other embodiments, a hearing aid includes a receiver that is configured to be placed at least partly in an ear canal of a user, the receiver comprising a motor and a receiver housing, and a sound tube having a longitudinal extension in at least two directions, wherein the sound tube has a total length of at least 16 mm, wherein the receiver housing is integrally formed with the sound tube.

In accordance with other embodiments, a hearing aid includes a behind the ear (BTE) unit configured to process sound and generate an electrical signal, an earpiece, and a signal conductor configured to communicate the electrical signal to the earpiece, wherein the earpiece comprises a receiver that is configured to convert the electrical signal into a sound signal, and wherein the earpiece further comprises a sound tube that is coupled to a sound port opening at the receiver, the sound tube having a longitudinal extension in at least two directions.

While several embodiments of three aspects have been described above, it is to be understood that any feature from an embodiment of one of the aspects may be combined with any feature(s) from embodiment(s) of any other aspect(s). Thus, when the term "embodiment" or "embodiments" is used in the specification, it is understood that it can be an embodiment or embodiments according to any one or combination of the three aspects, or any one or combination of any of the features associated with the three aspects.

BRIEF DESCRIPTION OF THE DRAWINGS

In the following, embodiments are explained in more detail with reference to the drawing, wherein.

DESCRIPTION OF PREFERRED EMBODIMENTS

Figure 1:
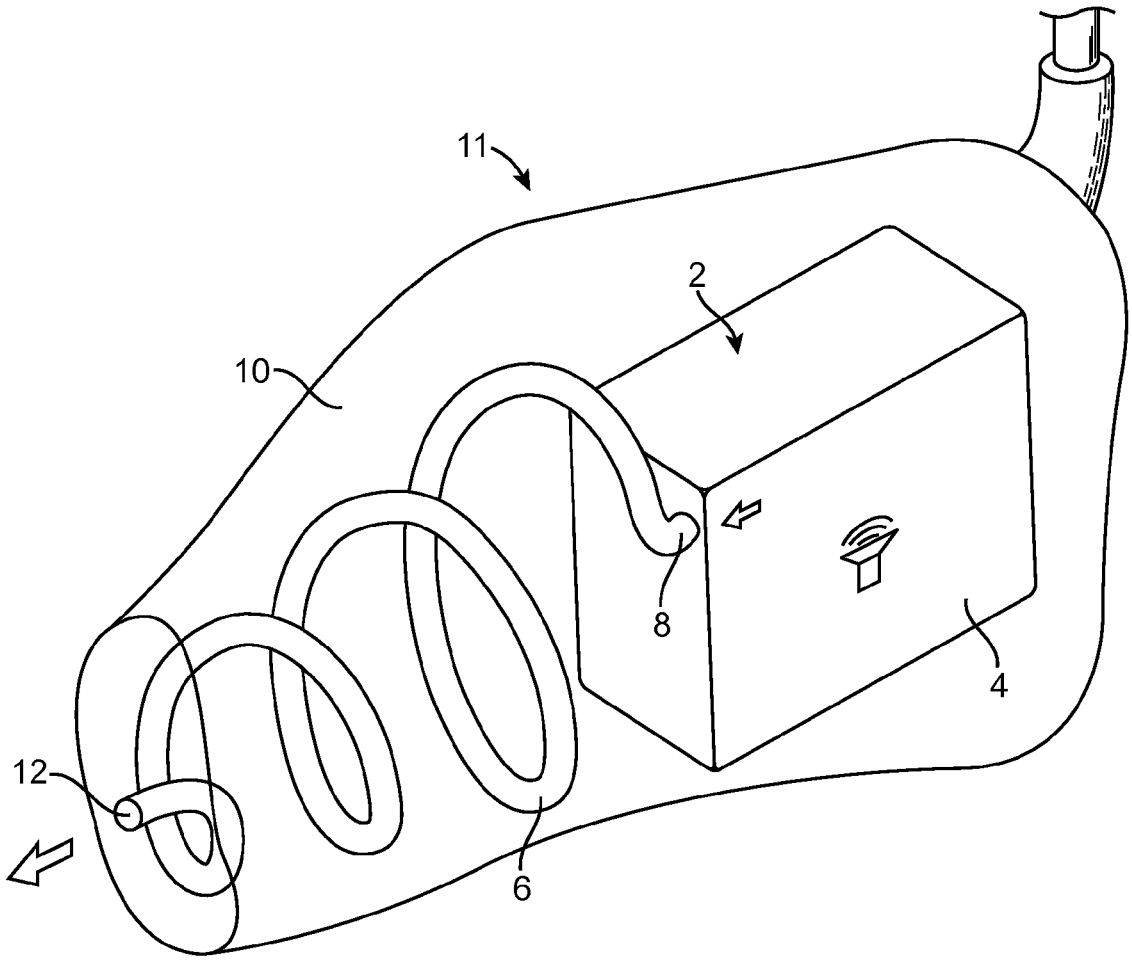
FIG. 1 shows a part of a hearing aid in accordance with some embodiments, particularly showing a first aspect.

Various embodiments are described hereinafter with reference to the figures. It should be noted that the figures are not drawn to scale and that elements of similar structures or functions are represented by like reference numerals or designations throughout the figures. Like elements will, thus, not be described in detail with respect to the description of each figure. It should also be noted that the figures are only intended to facilitate the description of the embodiments. They are not intended as an exhaustive description of the invention or as a limitation on the scope of the invention. The invention may, however, be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

Figure 9:
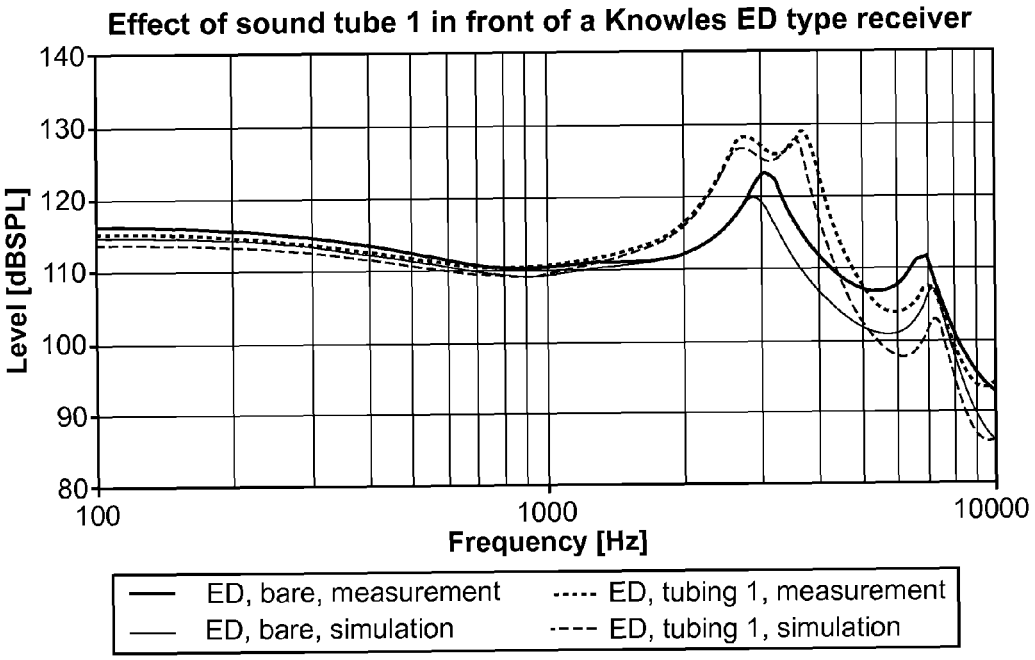
FIG. 9 shows a comparison of simulated and measured frequency responses with one exemplary sound tube construction. Increased output benefit of the sound tube and predictability of simulations are illustrated.
Figure 10:
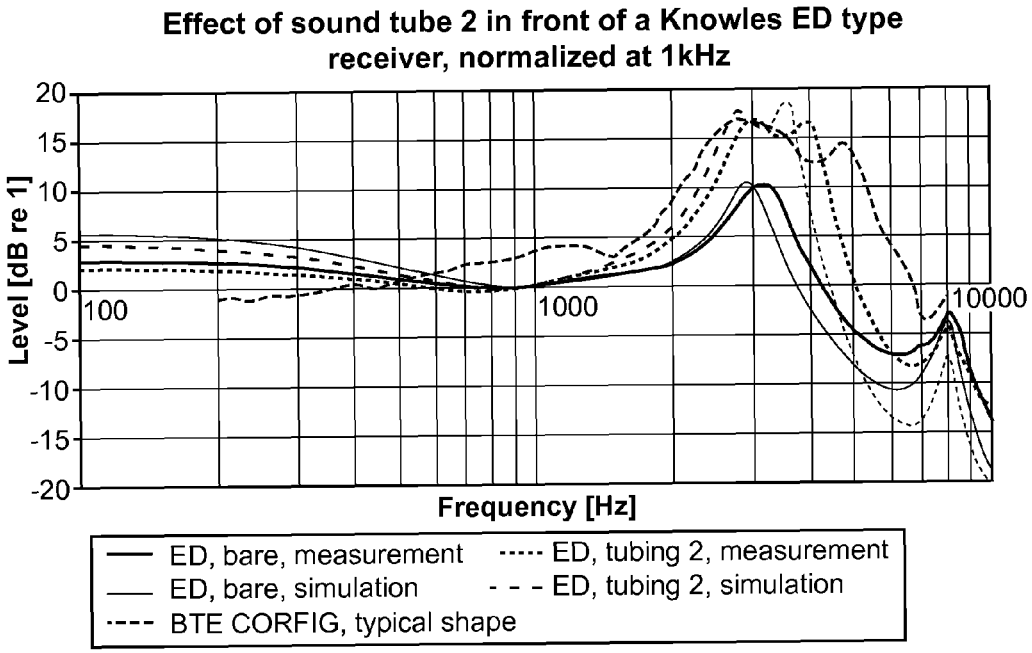
FIG. 10 shows a comparison of simulated and measured frequency responses with another exemplary sound tube construction. Benefit of better hearing aid insertion loss compensation is illustrated.

The designation number 6 is generally used to designate a sound tube, except with reference to the description of FIGS. 9 and 10, wherein the test tubes used in the experiments and simulations are denoted "sound tube 1" and "sound tube 2", respectively. Throughout the rest of present patent specification, the designation number 2 is generally used to designate a receiver.

FIG. 1 shows a part of an embodiment of a hearing aid with a receiver 2 placed in a receiver housing 4. In some embodiments, the receiver housing 4 may be considered to be a part of the receiver 2. The receiver 2 is configured to be placed in the ear of a user during use. The hearing aid further comprises a sound tube 6 acoustically connected to a sound port opening 8 of the receiver 2. In the illustrated embodiment, the sound tube 6 has a spiral form along its longitudinal extension, thus exhibiting a longitudinal extension in infinitely many directions. In the illustrated embodiment the sound tube 6 is preferably formed as an integral part of an eartip 10, and has preferably a longitudinal length of at least 16 mm. The eartip 10 with the sound tube 6 may be manufactured in one single piece using SLA or SLS technology, wherein the sound tube 6 is integrally formed as a channel within the eartip 10.

The eartip 10 may according to one embodiment be manufactured in standard sizes. However, according to a preferred embodiment the illustrated eartip 10 is provided in a custom version that is individually shaped to fit within the ear of a particular user and having a sound tube 6 of a, possibly predefined, length according to the acoustical performance needed and within the physical limitation within the ear and or ear cannel of the user. The exact shape of the sound tube 6 does not have to be spiral formed as illustrated in FIG. 1, but could be defined by a software program, picking at the receiver output port 8 and the opposite end 12 in front of the eartip 10. In the illustrated embodiment the eartip 10 forms an integral part of an earpiece 11.

Figure 2:
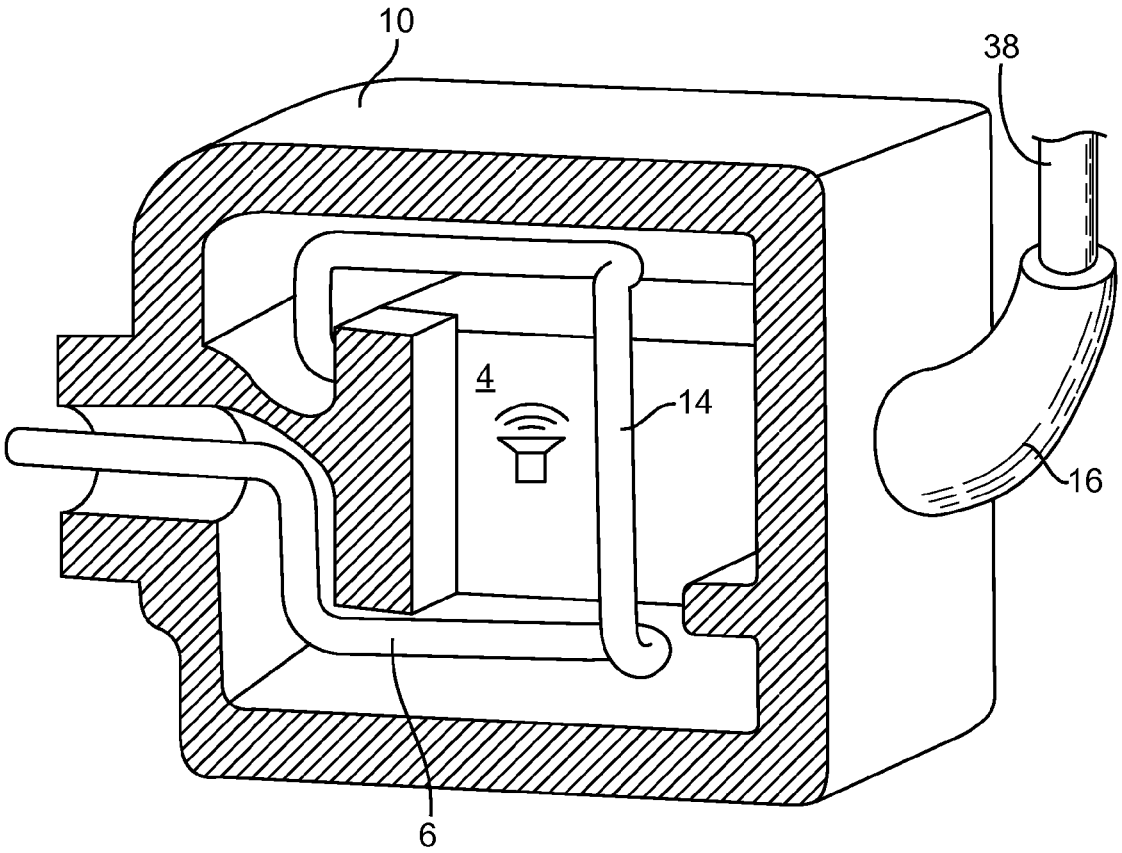
FIG. 2 shows an alternative embodiment of the hearing aid.

FIG. 2 shows a cross section of a part of an alternative embodiment of a hearing aid with a receiver 2 placed in a receiver housing 4. The receiver 2 is configured to be placed in the ear of a user during use. The hearing aid further comprises a sound tube 6 acoustically connected to a sound port opening (not shown) of the receiver 2. In the illustrated embodiment, the sound tube 6 has a piecewise linear form along its longitudinal extension, thus exhibiting a longitudinal extension in three different directions comprised in 8 linear pieces. In the illustrated embodiment the sound tube 6 is preferably formed as an integral part of an eartip 10 (or earpiece, since the words eartip and earpiece are used interchangeably throughout the present patent specification). The eartip 10 with the sound tube 6 may be manufactured in one single piece using SLA or SLS technology, wherein the sound tube 6 is integrally formed as a channel within the eartip 10.

The illustrated sound tube 6 abuts to the receiver housing 4 along the linear piece 14 of the sound tube 6. Hereby a smaller and more compact earpiece 11 is achieved.

Also shown in FIG. 2 is an electrical socket system 16 configured for providing an electrical connection between electrical terminals (not shown) of the receiver 2 and that part of the hearing aid which contains the audio signal processing unit (not shown) vie an electrical wire 38. In a preferred embodiment the electrical socket system 16 may be detachable.

Figure 3:
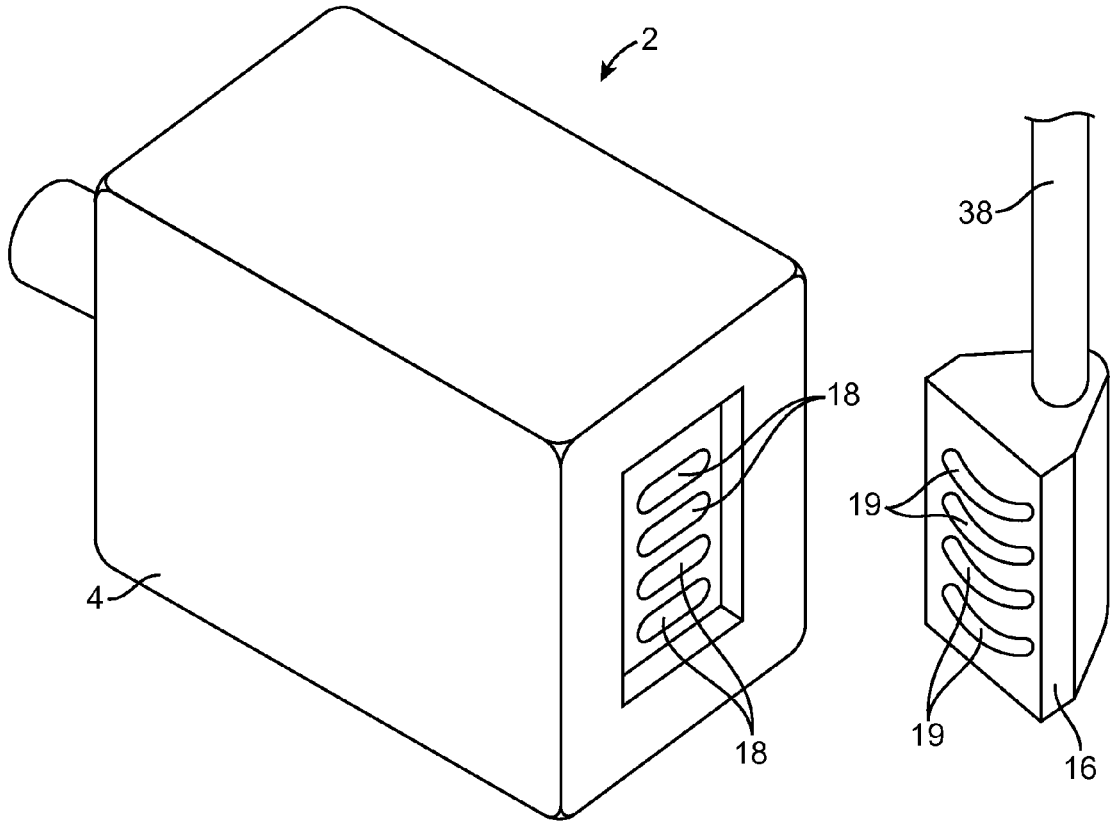
FIG. 3 shows a part of an embodiment of a hearing aid with a detachable electrical socket system.

FIG. 3 shows an embodiment of a part of a hearing aid with a detachable electrical socket system 16 for providing an electrical connection between electrical terminals 18 of the receiver 2 and corresponding electrical terminals 19 on the electrical socket system 16, so that the receiver thereby can be operatively connected to that part of the hearing aid which contains the audio signal processing unit (not shown) via an electrical wire 38.

Figure 4:
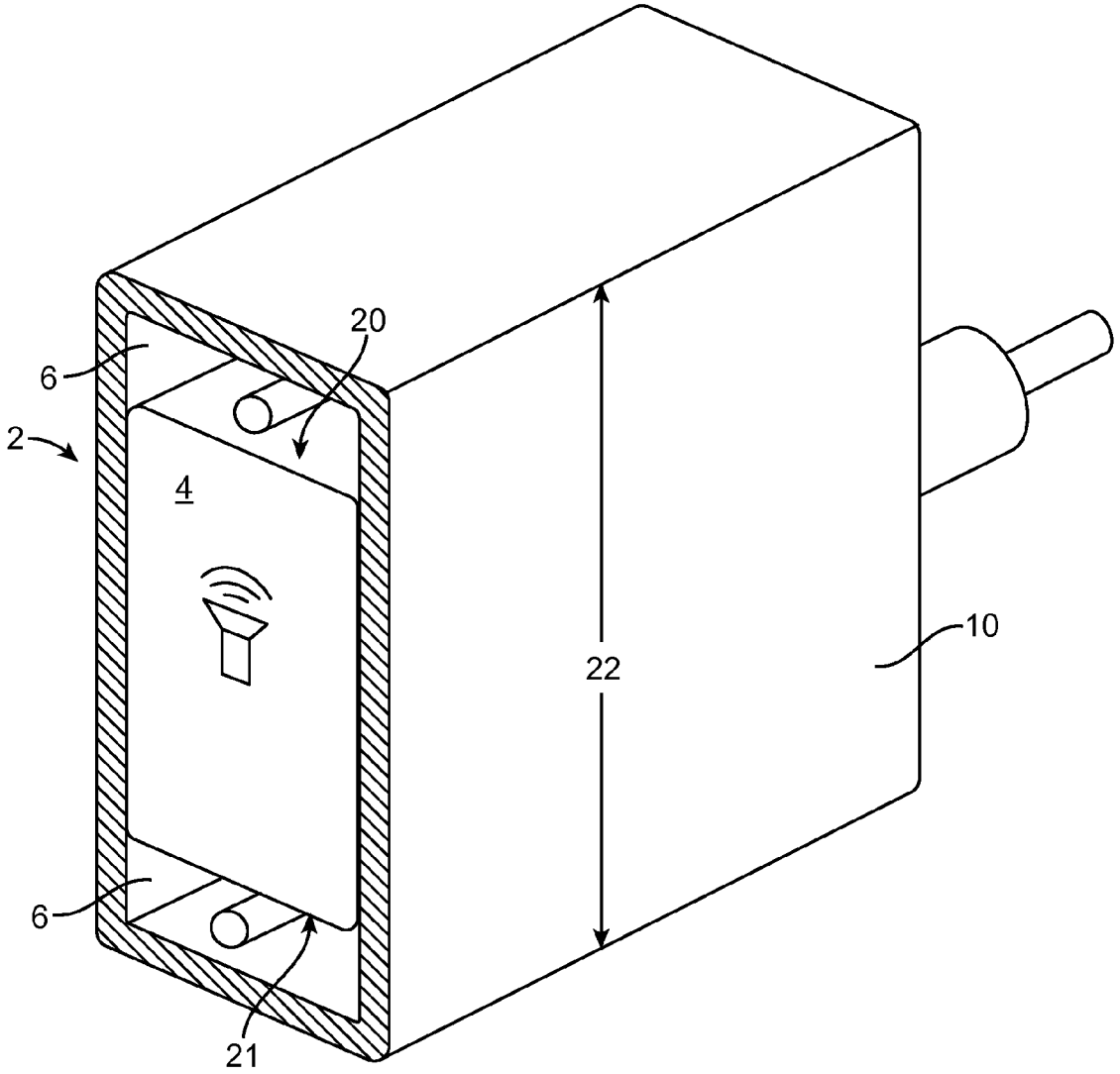
FIG. 4 shows a cross section of a receiver with a housing, to which housing a sound tube is attached.

FIG. 4 shows a perspective view of a cross section of a receiver 2 with a housing 4, to which housing a sound tube 6 is attached. The illustrated sound tube 6 has a rectangular cross section. The sound tube 6 thus has a large contact surface 20 that abuts to the housing 4 of the receiver 2. This has the effect that the spatial extension of the combined receiver 2 and sound tube 6 along the direction 22 is minimized as compared to using a sound tube 6 that has a circular cross section.

Figure 5:
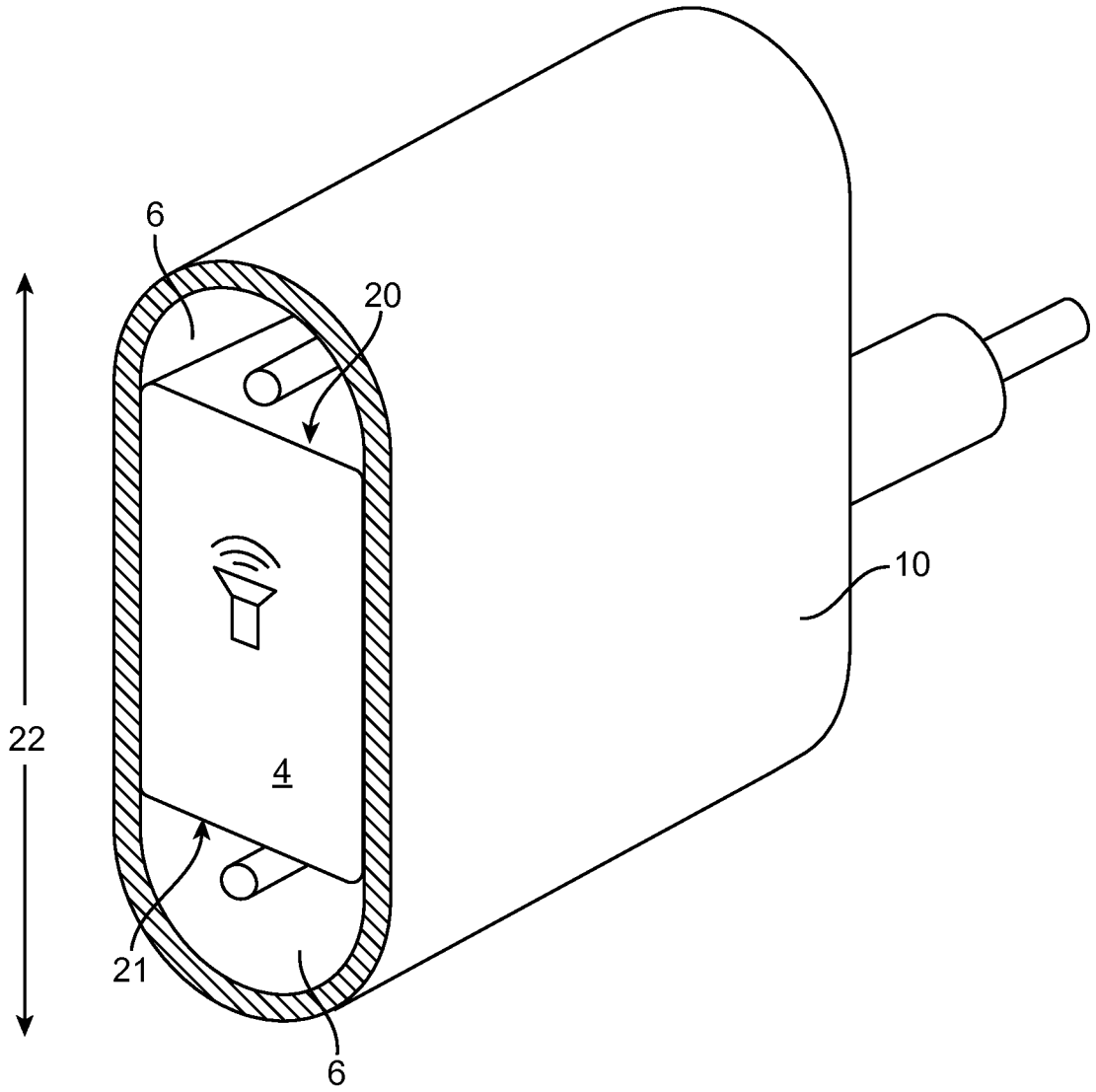
FIG. 5 shows cross section of an alternative space saving configuration of the sound tube and receiver.

FIG. 5 shows a perspective view of a cross section of an alternative space saving configuration of the sound tube 6 and receiver 2.

The receiver 2 and eartip 10 with the sound tube 6 as illustrated in any of the FIGS. 1-5 may in one embodiment form part of a so called ITE hearing aid. In an alternative embodiment the illustrated receiver 2 and eartip 10 with the sound tube 6 may from part of a CIC hearing aid, and in yet an alternative embodiment the illustrated receiver 2 and eartip 10 with the sound tube 6 may from part of an earpiece for a RIE hearing aid.

The sound tube 6 illustrated in one of the FIGS. 1-5 may have a longitudinal length that is larger than the longitudinal extension of the receiver 2, and in an alternative embodiment the sound tube 6 as illustrated in one of the FIGS. 2-5 may have a longitudinal length along one of the at least two directions that is larger than a longitudinal length of the receiver 2. Preferably, the overall longitudinal length of the sound tube 6 illustrated in any of the FIGS. 1-5, may be between 18 mm. and 26 mm., even more preferably between 20 mm. and 24 mm.

Figure 6:
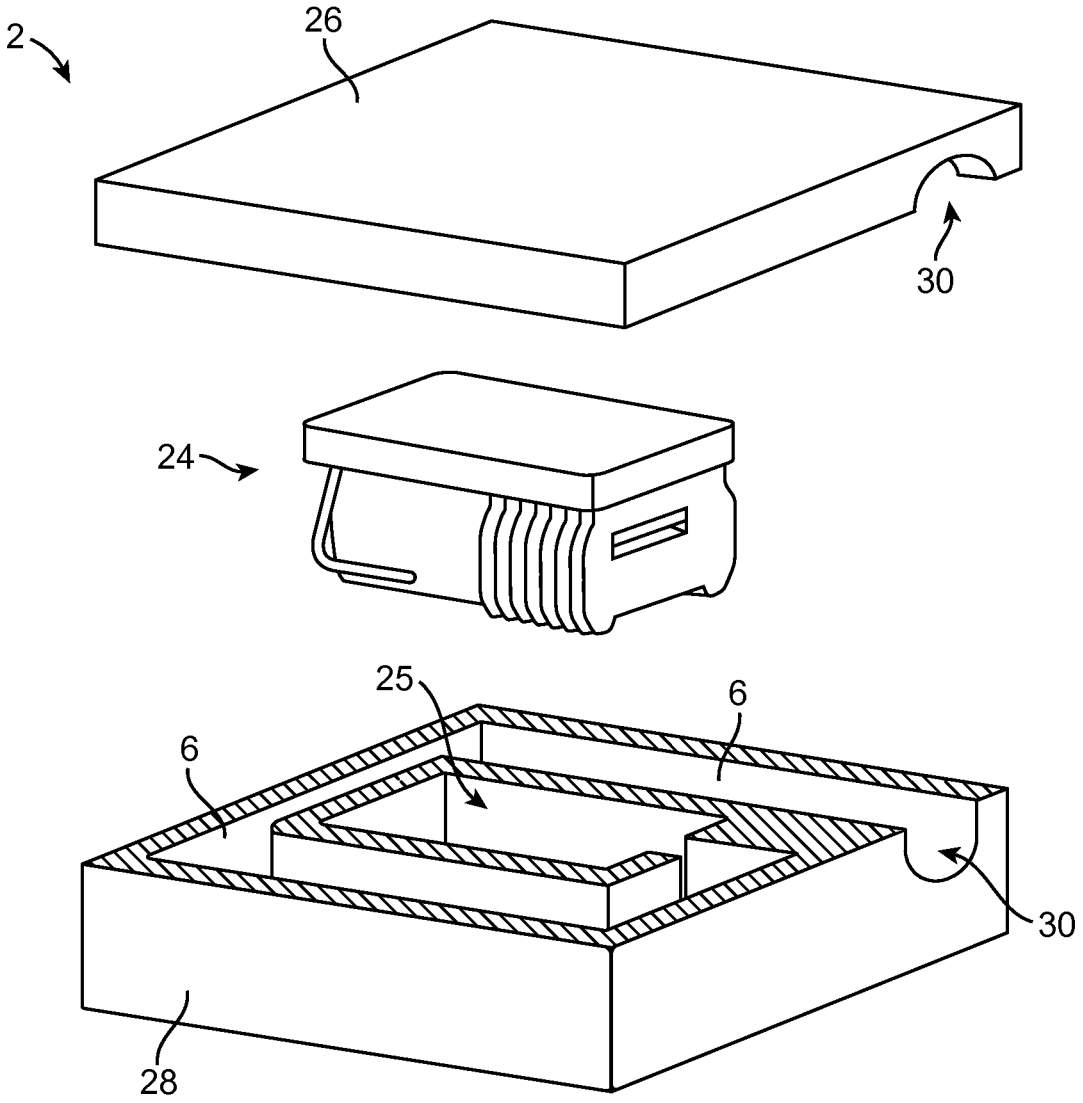
FIG. 6 shows a part of a hearing aid according to other embodiments, particularly showing a second aspect.

FIG. 6 shows a part of a hearing aid according to a second aspect. Illustrated in FIG. 6 is an explosion view of a receiver 2 that is adapted to be placed at least partly in the ear or ear canal of a user. The receiver 2 comprises a motor 24 and a receiver housing made from the two pieces 26 and 28. The receiver housing has an integrally formed sound tube 6 which has a total length of at least 16 mm and a longitudinal extension in at least two directions. The sound tube 6 may in one embodiment be formed as an integral part of one of the pieces 26 or 28, or it may, as illustrated, be formed as an integral part of both of the pieces 26 or 28 as matching groves in booth of the housing pieces 26 and 28. The sound generated by the receiver motor 24 is then influenced by the sound tube 6 in such a way that it will be enhanced due to the resonance properties of the sound tube 6 before it is emitted through the sound output port 30 of the receiver 2. The receiver 2 may be operatively connected to another part of the hearing aid that contains a signal processing unit via a cable connection (not shown).

Figure 7:
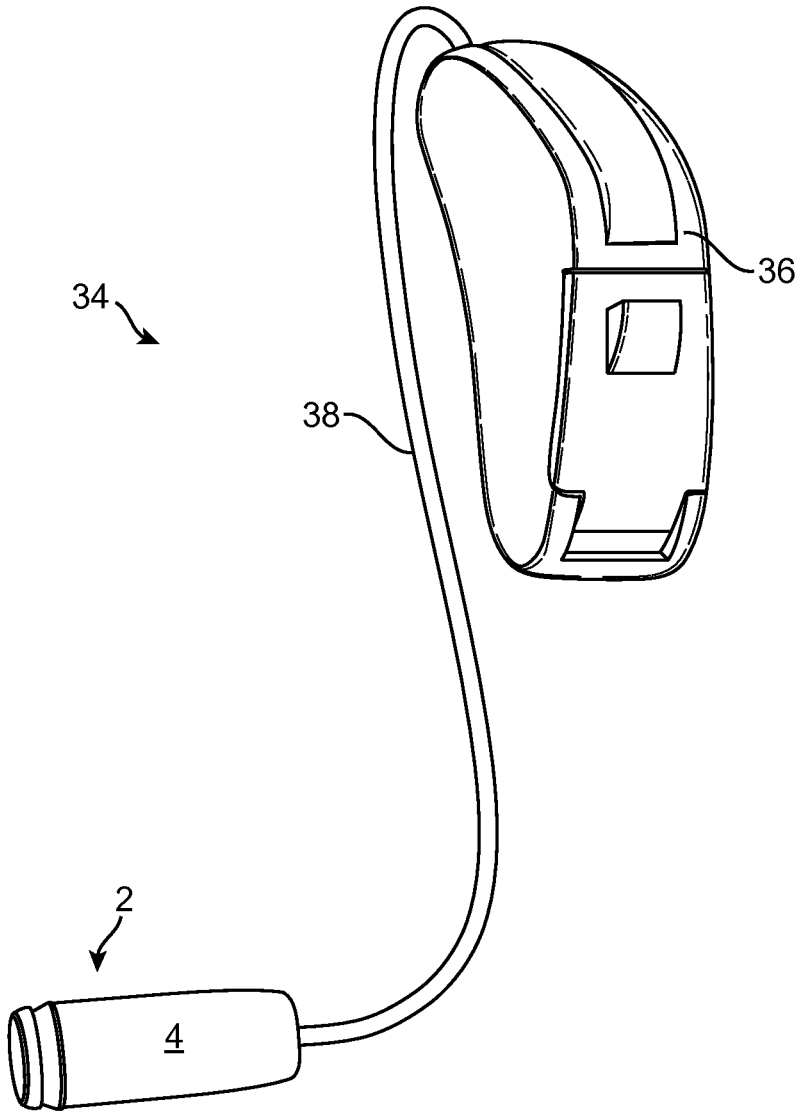
FIG. 7 shows a hearing aid according to other embodiments, particularly showing a third aspect.

FIG. 7 shows a hearing aid 34 according to a third aspect. The illustrated hearing aid 34 comprises a behind the ear (BTE) unit 36 configured to convert and process sound into an electrical signal and a signal conductor 38 (e.g. a wire) configured to communicate said electrical signal to an earpiece (not shown). The earpiece (not shown) comprises a receiver 2 that is configured to convert the electrical signal into a sound signal. The earpiece (not shown) further comprises a sound tube (not shown) that is connected to the sound port opening (not shown) of the receiver 2. The sound tube (not shown) has further a longitudinal extension in at least two directions.

In an alternative embodiment the earpiece (not shown) may comprise a receiver 2 and sound tube 6 as illustrated in any of the embodiments shown in any of the FIGS. 1-5. In yet an alternative embodiment of the hearing aid 34 illustrated in FIG. 7, the earpiece (not shown) may comprise a receiver 2 as illustrated and explained with reference to FIG. 6, wherein the sound tube 6 is formed as an integral part of the receiver housing provided by the two pieces 26 and 28.

Figure 8:
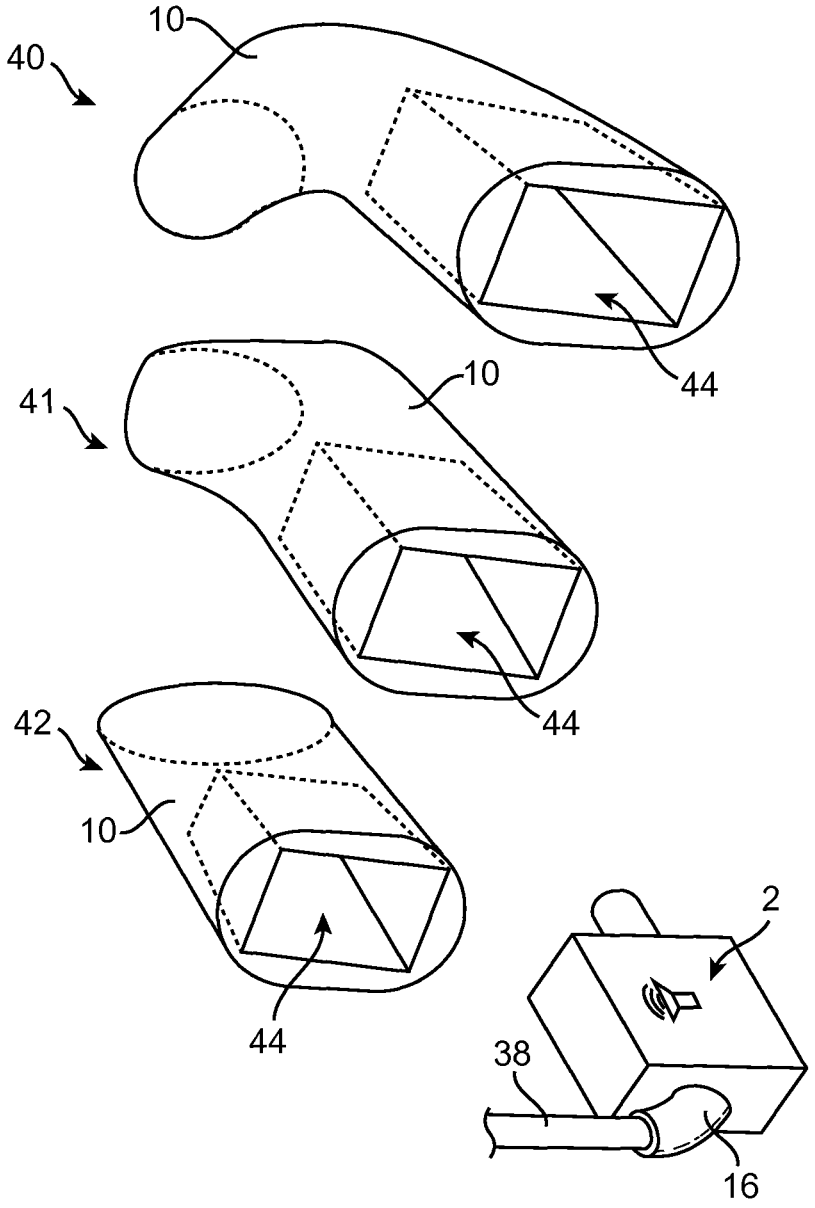
FIG. 8 shows three earpieces and a receiver.

FIG. 8 shows three earpieces 40, 41, 42 and a receiver 2. The earpieces 40, 41 and 42 may each comprise a sound tube (not shown) that may be forming an integral part of the tip portion 10 of said earpieces 40, 41 or 42, for example as illustrated in any of the FIG. 1 or 2. The earpieces each have a cavity 44 that is adapted to receive the receiver 2 and which preferably snugly fits to at least a part of the outer contours of the receiver housing 4. Alternatively, the sound tube (not shown) may form an integral part of the receiver housing 4, as e.g. illustrated in FIG. 6, in which case the earpieces 40, 41 or 42 therefore not need to have a sound tube integrated into them. However, in yet an alternative embodiment the sound tube (not shown) could partly be formed in any of the earpieces 41, 41 or 42 and partly be formed in the housing 4 of the receiver 2. The receiver 2 is connected to a BTE unit (not shown) via a wire 38 that is connected to the receiver 2 via the electrical socket 16.

FIG. 9 shows a comparison of simulated and measured frequency responses, with a constant voltage drive, with one exemplary sound tube (termed sound tube 1), compared to a response with no sound tube attached. The sound tube consists of two attached tubes of different length and cross section area with the following dimensions: 12 mm. length with a diameter of 3 mm. followed by a length of 10 mm. having a diameter of 2.5 mm. Secondly, a receiver that is fit for RIE/ITE applications is used for the actual measurements. In this example a Knowles type ED receiver has been used.

The receiver has been measured and simulated under standard RIE conditions, i.e. with no sound tube between the receiver and the coupler (or the ear canal of a user). In the measurements, the IEC 711 ear simulator was used as the measurement coupler. This corresponds to conditions for standard RIE type of hearing aids known in the art. The result of this measurement is illustrated by the thick solid line (termed ED, bare, measurement) exhibiting a resonance peak around 3 kHz. The computer simulation of the same condition is given by the thin solid line (termed ED, bare, simulation). The difference in the measured in simulated responses do not have a significant impact in predicting the effect of the sound tube.

Then by computer simulations the frequency response of the RIE type of hearing aid is modified. The sound tube 1 as given above was physically built and measured as well as simulated, with good agreement between the two. The former is presented by the thick dashed line (termed ED, tubing 1, measurement), while the latter is presented by the thin dashed line (termed ED, tubing 1, simulation) in FIG. 9.

When a sound tube is placed in front of a receiver the acoustic path is changed in two ways. First, the so called acoustic mass (which is proportional to L/S of the tube, where L is the length and S is the cross sectional area) is added in front of the receiver membrane. Secondly, a waveguide is created which in one end is coupled to the receiver and wherein the other end of the sound tube is coupled with the ear canal (or a measurement coupler).

Adding the acoustic mass will affect the two original receiver resonances. The first resonance peak is around 3 kHz (see the solid lines) and that is the mechanical resonance of the receiver, which is determined by the stiffness of the suspension system and the mass of the moving system. The added acoustic mass in the sound tube is large enough to affect the mechanical resonance and it shifts a little bit lower in frequency (see the first resonance peak in the dashed lines as compared to the first resonance peak in the solid lines). The added acoustic mass also affects the resonance peak around 7 kHz-8 kHz and fine tuning here can be beneficial for adjusting the system bandwidth.

The influence on the mechanical resonance is dependent on the receiver type, with the effect being more pronounced for smaller receivers than for larger ones.

More importantly, the waveguide effect creates an additional resonance peak, around 3.8 kHz (the second resonance peak in dashed lines). The frequency of this resonance peak corresponds approximately to the quarter wavelength resonance of the sound tube.

It may be shown that in the simplest possible system, i.e. a system wherein a straight sound tube is connected to a rigid piston in one end and the other end being open will exhibit a resonance exactly at $$F_{res} = \frac{c}{4 - L},$$

where c is the speed of sound that normally can be set to be 343 m/s (for dry air at 20 degrees Celsius), and L is the length of the sound tube.

As may be seen from the thick dashed line in FIG. 9, the approximation of c/(4*L) still applies to a real system, but we cannot expect exact numbers. However, it is still good enough to provide an estimate on the sound tube length range (around 18 mm. to 26 mm, preferably around between 20 mm. and 24 mm., even more preferably between around 18 mm. and 24 mm.) in order not to put the two resonance peaks (of the dashed lines) to far apart, because that will lead to a big valley between them.

Accordingly, it is seen that a hearing aid according to some embodiments described herein is able to provide a higher output sound pressure level (which can readily be seen by comparing the dashed lines to the solid lines in FIG. 9) and a broader peak around 3 kHz (this can also be seen by comparing the dashed lines to the solid lines in FIG. 9) using the existing electrical hearing aid hardware, i.e. existing signal processor(s) and receiver(s) as compared to standard RIE type of hearing aids known in the art. The benefits of improved output are better dynamic range of the hearing aid, and, if stability allows, higher maximum gain.

FIG. 10 shows another sound tube construction (termed sound tube 2) that basically has the same inner dimensions as tube 1. However, sound tube 2 is one that has a form similar to the form of the sound tube 6 illustrated in FIG. 2. Here the benefit of better match to a target hearing aid insertion loss curve (termed BTE CORFIG, typical shape) is shown. Again, a Knowles ED type receiver was chosen for the experiment and simulation. The difference between the ED shown in FIG. 9 is the absence of a sound port. The receiver responses are normalized to 1 kHz. Also here the IEC 711 ear simulator was used as the measurement coupler.

The dotted line is a typical shape of the hearing aid insertion loss compensation curve for to a BTE device (which is also applicable to a RIE device), termed BTE CORFIG, typical shape. The shape illustrated in FIG. 10 is also valid for the IEC 711 ear simulator.

Apart from the increased output, the benefit of the sound tube can clearly be seen as both dashed curves (receiver with sound tube 2) can match the CORFIG better than the solid curves (bare receiver, i.e. without sound tube). Here CORFIG is an acronym for Coupler Response for Flat Insertion gain. By inserting an ear mould (e.g. a custom made ITE or CIC hearing aid or an earpiece for a BTE type of hearing aid) into the ear canal of a user, the natural sound transmission of sound to the ear drum is disrupted. This is commonly referred to as the so called insertion loss. A hearing aid must be able to compensate for this insertion loss, for example by setting a suitable insertion gain in the hearing aid, before any hearing impairment correction gain can be applied. To this end response targets are measured and defined. For example a compensation response (or gain) curve is defined for each hearing aid type, termed CORFIG, and a hearing aid must have a frequency response that is as close as possible to a given CORFIG in order to be able to properly compensate for the insertion loss. As can be seen from FIG. 10 the exemplary hearing aid has a response (the dashed curves) that fits much better to the typical CORFIG (dotted curve) of a BTE hearing aid.

Figure 11:
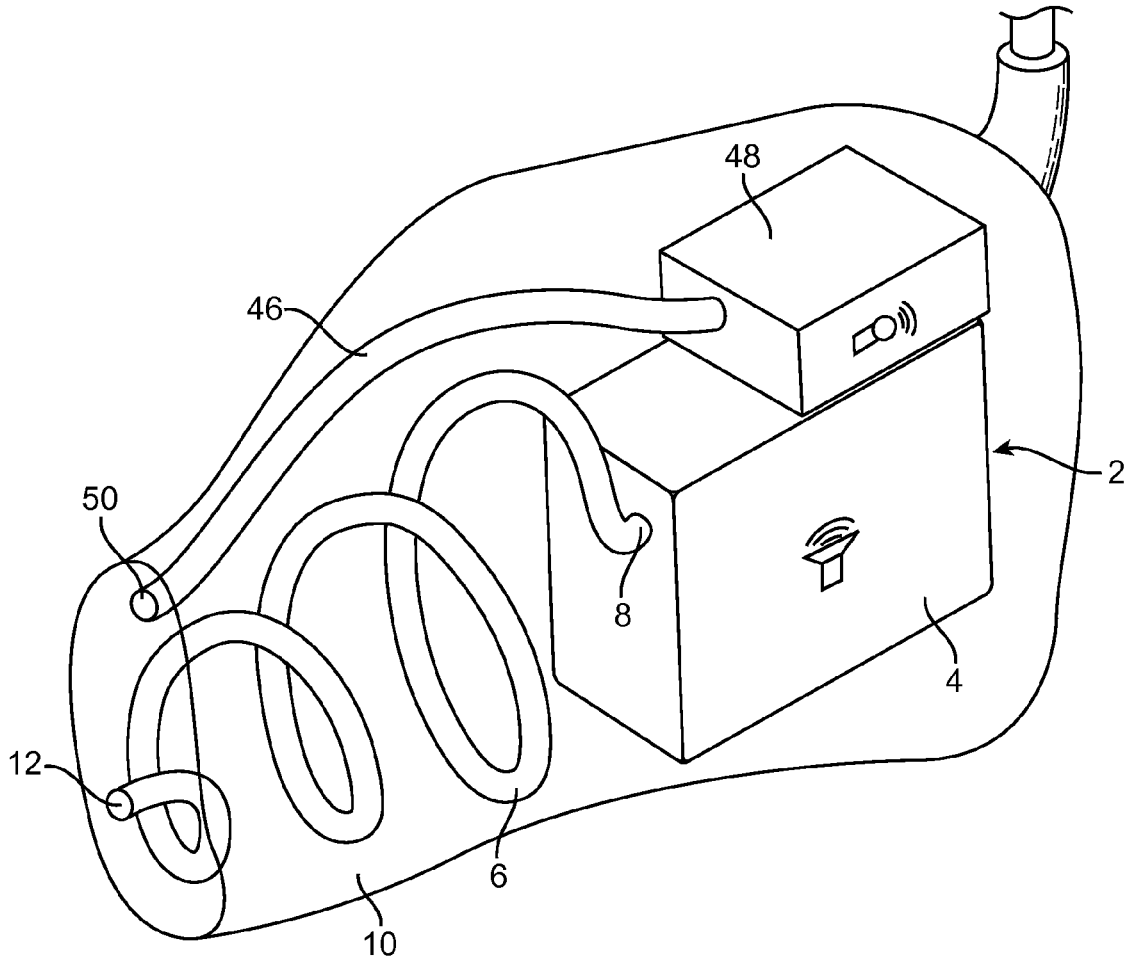
FIG. 11 shows a part of an embodiment of a hearing aid with a microphone in the earpiece.

FIG. 11 shows a part of an embodiment of a hearing aid with a receiver 2 placed in a receiver housing 4. Since the illustrated embodiment shown in FIG. 11 is very similar to the one illustrated in FIG. 1, only the differences will be described. In addition to the features already described with reference to FIG. 1, the embodiment illustrated in FIG. 11 also comprises a second sound tube 46 that is connected to a microphone 46 in one end and has another free end with an opening 50. When the eartip 10 is placed in the ear canal of a user, the microphone 48 will be able to pick up the sound field within the ear canal of said user via the second sound tube 46.

When talking or chewing, bone conducted vibrations are conducted to the ear canal. These vibrations generate air vibrations (sound) within the ear canal that normally escape through an open ear canal, so most people are unaware of their existence. However, when the ear canal is blocked with a hearing aid or earpiece of a hearing aid, these air vibrations are reflected back toward the eardrum. This is referred to as the so called occlusion effect. Compared to a completely open ear canal, the occlusion effect can boost low frequency (usually below 500 Hz) sound pressure in the ear canal by 20 dB or more. Thus, this occlusion effect may be very annoying for a hearing aid wearer. However, with the help of the microphone 48 it is possible to measure the occlusion effect during use of the illustrated eartip 10, and thereby accounted for.

Figure 12:
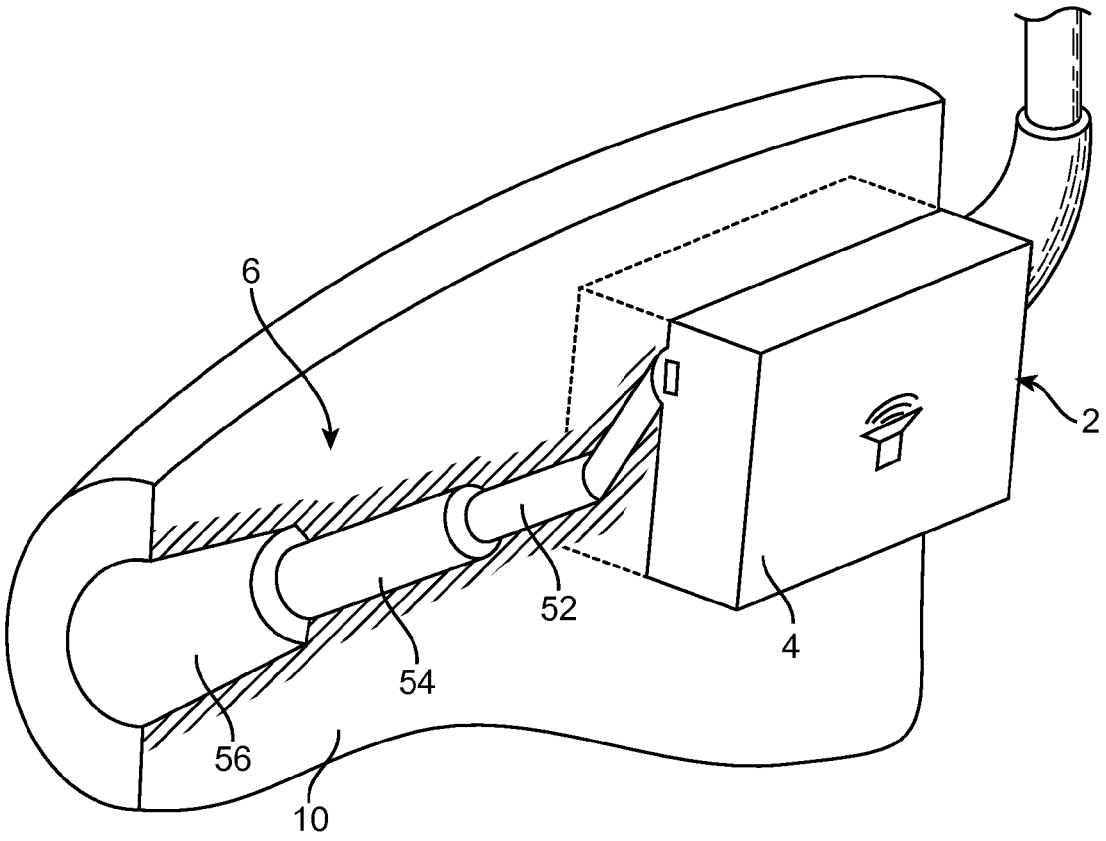
FIG. 12 shows a part of an embodiment of a hearing aid with a sound tube having increasing cross sectional area.

FIG. 12 shows a part of an embodiment of a hearing aid with a sound tube 6 having increasing cross sectional area. The sound tube 6 has an extension in two directions, but could in other embodiments have a longitudinal extension in more that two directions. A part of the illustrated sound tube 6 has three sections 52, 54 and 56 of stepwise increasing cross sectional area. This kind of sound tube enables additional degrees of freedom in designing a system with a certain desired frequency response.

Figure 13:
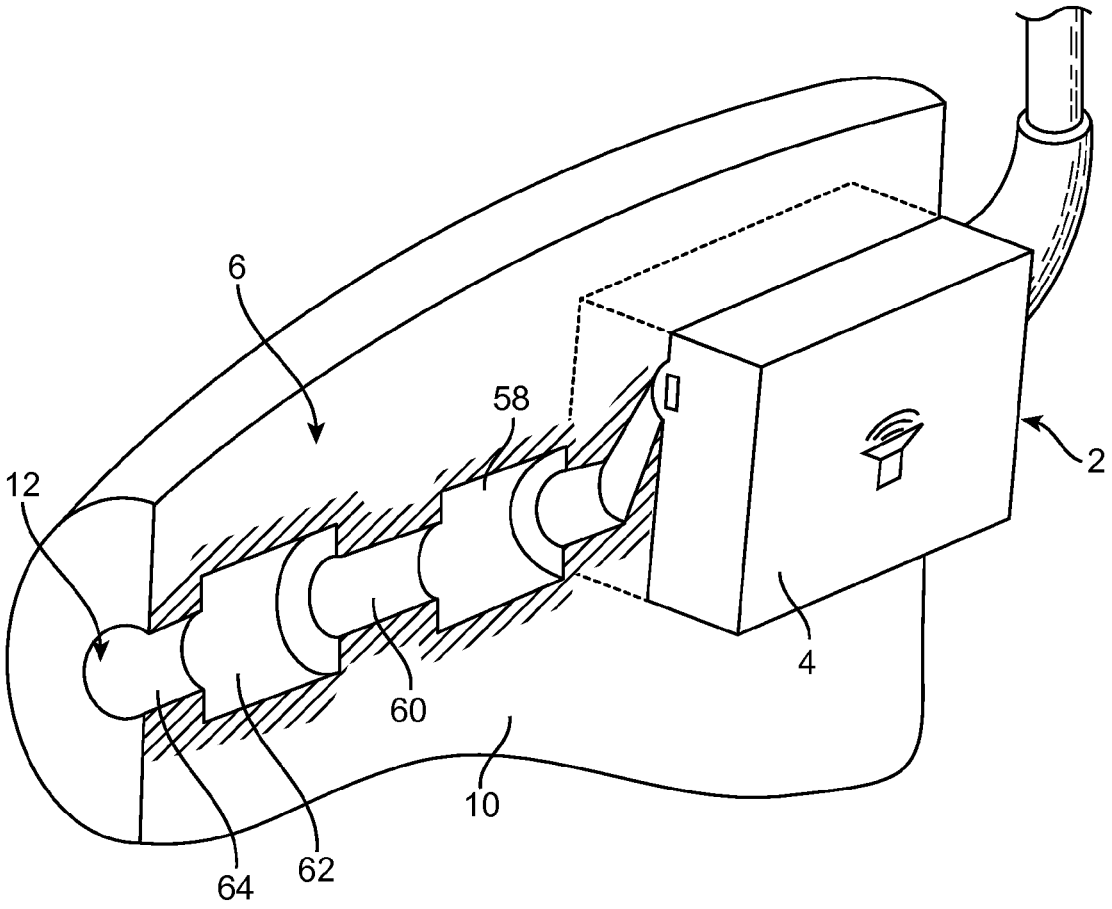
FIG. 13 shows a part of an embodiment of a hearing aid with a sound tube having increasing and decreasing cross sectional area.

FIG. 13 shows a part of an embodiment of a hearing aid with a sound tube 6 having stepwise increasing and decreasing cross sectional areas. The sound tube 6 has a section 58 of increased cross sectional area followed by a section 60 of decreased cross sectional area, which in turn is followed by a section 62 of increased cross sectional area that again is followed by a section 64 of decreased cross sectional area. The cross sectional area of the sections 58 and 62 may be substantially equal or alternatively they may be different from each other. Similarly, the cross sectional area of the sections 60 and 64 may be substantially equal or alternatively they may be different from each other. The sections 58 and 62 define two resonance chambers within the sound tube 6.

Figure 14:
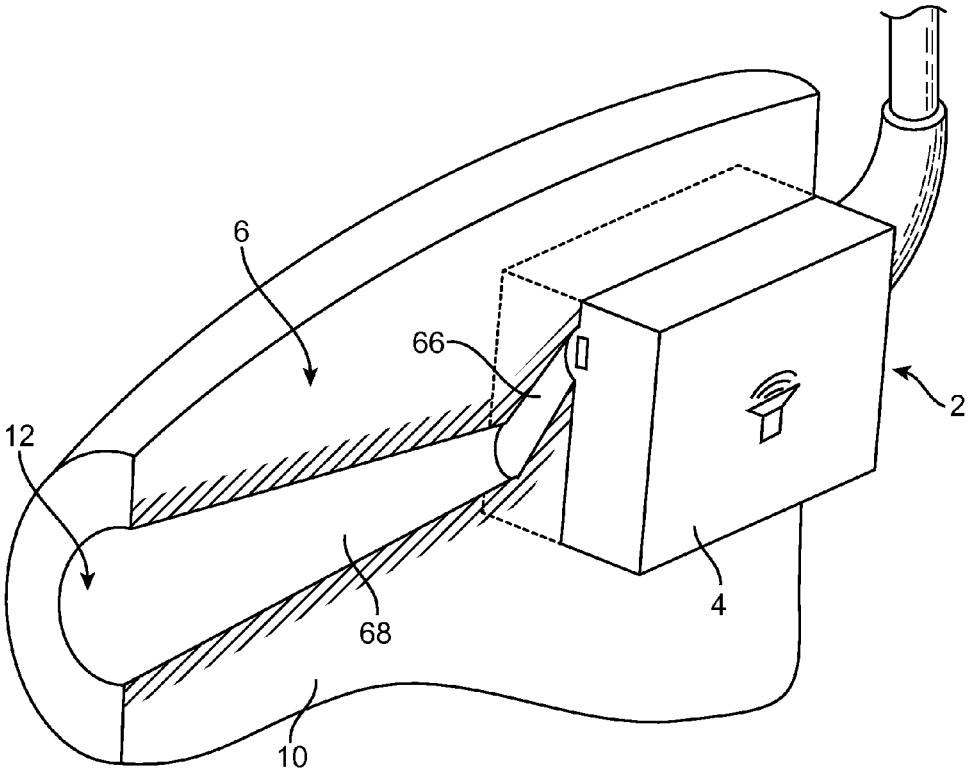
FIG. 14 shows a part of an alternative embodiment of a hearing aid with a sound tube having increasing cross sectional area.

FIG. 14 shows a part of an alternative embodiment of a hearing aid with a sound tube 6 having increasing cross sectional area. The sound tube 6 has two sections 66 and 68 each of which extending in a different direction along the longitudinal extension of the sound tube 6. The section 68 has a gradually, i.e. step less, increasing cross sectional area in the direction toward the sound output 12.

Figure 15:
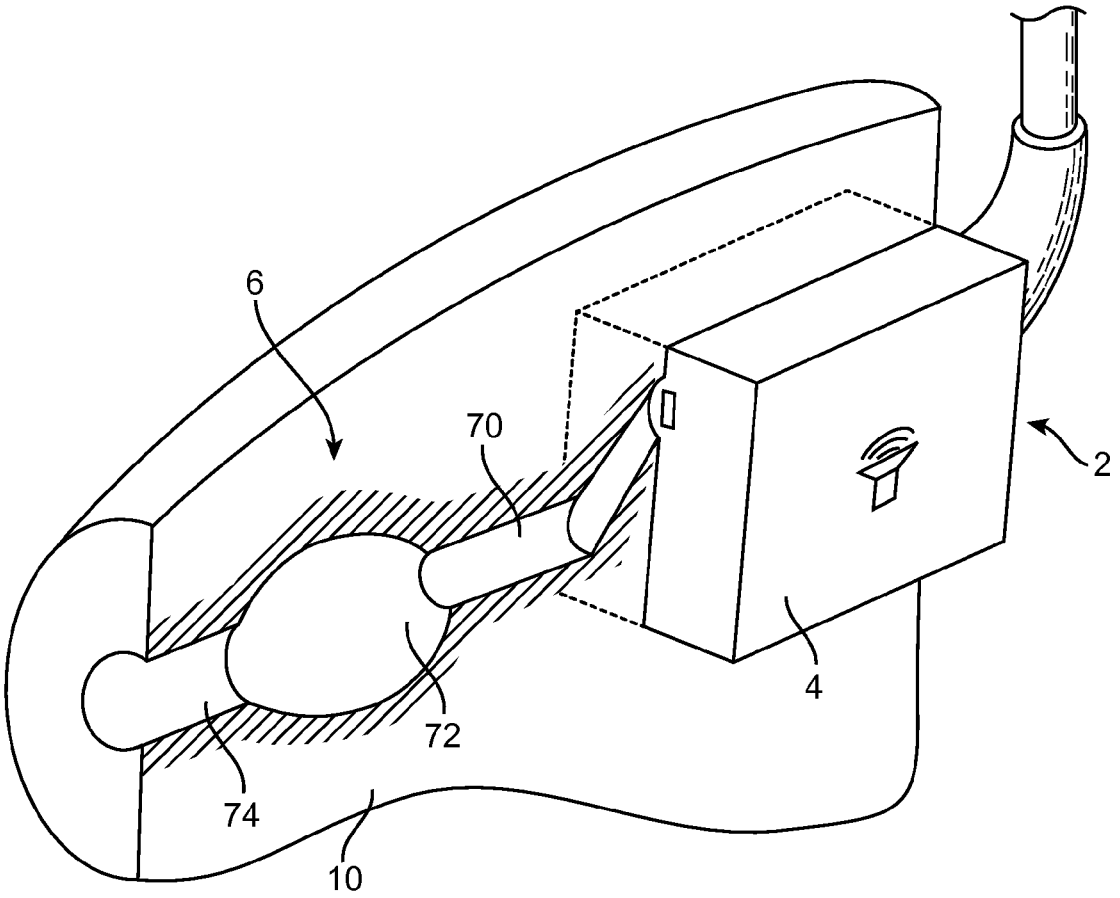
FIG. 15 shows a part of an alternative embodiment of a hearing aid with a sound tube having increasing and decreasing cross sectional area.

FIG. 15 shows a part of an alternative embodiment of a hearing aid with a sound tube 6 having a gradually increasing and decreasing cross sectional area. The sound tube 6 has a section 70 followed by a section 72, that in turn is followed by a section 74. The section 72 has a gradually, i.e. step less, increasing and decreasing cross sectional area, whereby the sound tube section 72 defines a cavity or resonance chamber within the sound tube 6.

The sound tube 6 illustrated in any of the FIGS. 1, 2, 4-6, and 11-15, may comprise a cerumen filter.

Although particular embodiments of the present inventions have been shown and described, it will be understood that it is not intended to limit the present inventions to the preferred embodiments, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

The invention claimed is:

1. A hearing aid comprising:

an earpiece comprising:

a receiver having a sound port and being configured to be placed at least partly in an ear canal of a user; and a sound channel having a first end acoustically coupled to the sound port of the receiver, and a second end configured to provide sound for output by the earpiece, at least a part of the sound channel having a longitudinal extension in at least two non-parallel directions, wherein the sound channel is in the earpiece, and a length of the sound channel from the first end to the second end is between 18 mm and 26 mm.

2. The hearing aid according to claim 1, wherein the receiver comprises a receiver housing, and the sound channel at least in part is defined by at least two sides of the receiver housing.

3. The hearing aid according to claim 1, wherein the receiver has a receiver housing, and wherein the hearing aid further includes a tube defining the sound channel located in the receiver housing.

4. The hearing aid according to claim 1, wherein the length of the sound channel from the first end to the second end is longer than a longitudinal length of the receiver.

5. The hearing aid according to claim 1, wherein the sound channel has at least two different cross sectional areas.

6. The hearing aid according to claim 1, wherein the earpiece further comprises a detachable electrical socket system.

7. The hearing aid according to claim 1, wherein the sound channel is formed as a predefined part to be mounted to the receiver.

8. The hearing aid according to claim 1, wherein the receiver comprises a receiver housing, the sound channel is in the receiver housing, and the sound channel is defined by a material that forms the receiver housing.

9. The hearing aid according to claim 1, wherein the sound channel has a configuration that is user-specific.

10. The hearing aid according to claim 1, wherein the sound channel is in a component manufactured by a Rapid Prototyping Technology.

11. The hearing aid according to claim 10, wherein the Rapid Prototyping Technology comprises SLS.

12. The hearing aid according to claim 10, wherein the Rapid Prototyping Technology comprises SLA.

13. The hearing aid according to claim 1, further comprising a microphone that, during use, is configured to pick up sound from within the ear canal of the user.

14. The hearing aid according to claim 1, wherein a cross sectional area of the sound channel increases along at least a part of a longitudinal extension of the sound channel from the sound port opening.

15. The hearing aid according to claim 14, wherein the cross sectional area of the sound channel increases gradually.

16. The hearing aid according to claim 14, wherein the cross sectional area of the sound channel increases in a stepwise manner.

17. The hearing aid according to claim 14, wherein the cross sectional area of the sound channel increases partly gradually and partly in a stepwise manner.

18. A hearing aid comprising:

a behind the ear (BTE) unit configured to process sound and generate an electrical signal;

an earpiece; and a signal conductor configured to communicate the electrical signal to the earpiece;

wherein the earpiece comprises a receiver that is configured to convert the electrical signal into a sound signal, the receiver configured to be placed at least partially in an ear canal of a user;

wherein the earpiece further comprises a sound channel having a first end that is coupled to a sound port opening at the receiver, and a second end configured to provide sound for output by the earpiece, at least a part of the sound channel having a longitudinal extension in at least two non-parallel directions; and wherein a length of the sound channel from the first end to the second end is between 18 mm and 26 mm.

19. The hearing aid of claim 18, wherein the receiver has a receiver housing, and the sound channel is in the receiver housing.

20. The hearing aid of claim 18, further comprising a tube in the earpiece, wherein the sound channel is defined by the tube.

21. The hearing aid of claim 18, wherein the sound channel is defined by a material that forms the earpiece.

22. The hearing aid of claim 1, wherein the earpiece further comprises a tube defining the sound channel.

23. the hearing aid of claim 22, wherein the tube abuts a receiver housing of the receiver.

24. The hearing aid of claim 22, wherein the tube has a pre-determined shape.

25. The hearing aid of claim 1, wherein the sound channel has a curvilinear segment, and a first rectilinear segment connected to one end of the curvilinear segment.

26. The hearing aid of claim 25, wherein the sound channel has a second rectilinear segment connected to another end of the curvilinear segment.

27. The hearing aid of claim 26, wherein the first rectilinear segment and the second rectilinear segment form a 90° angle.

28. The hearing aid of claim 1, wherein the sound channel has a spiral configuration.

29. The hearing aid of claim 1, wherein the earpiece further comprises an earpiece shell accommodating the receiver, the sound channel is in the earpiece shell, and the sound channel is defined by a material that forms the earpiece shell.

30. The hearing aid of claim 10, wherein the component comprises a receiver housing or an earpiece shell.

31. A hearing aid comprising:

a receiver housing;

wherein the receiver housing has a sound channel, the sound channel having a first end, and a second end configured to provide sound for output by the hearing aid, at least a part of the sound channel having a longitudinal extension in at least two non-parallel directions, wherein a length of the sound channel from the first end to the second end is between 18 mm and 26 mm.

32. The hearing aid of claim 31, wherein the sound channel is defined by the receiver housing.

33. The hearing aid of claim 31, further comprising an earpiece surrounding the receiver housing.

34. The hearing aid of claim 31, wherein at least a portion of the sound channel is defined by a side of the receiver housing.

35. The hearing aid of claim 31, wherein at least a portion of the sound channel is defined by two sides of the receiver housing.

* * * * *